United States Patent [19]

Leone

[11] 4,238,978

[45] Dec. 16, 1980

[54] TORQUE WRENCH

[75] Inventor: Richard P. Leone, Wayland, Mass.

[73] Assignee: Lowell Corporation, Worcester, Mass.

[21] Appl. No.: 21,087

[22] Filed: Mar. 16, 1979

[51] Int. Cl.[3] ..... B25B 19/00

[52] U.S. Cl. ..... 81/480; 64/29

[58] Field of Search ..... 81/52.4 R; 64/29

[56] References Cited

U.S. PATENT DOCUMENTS

| | | | |
|---|---|---|---|
| 2,157,574 | 5/1939 | Siesel | 64/29 |
| 2,601,799 | 7/1952 | Garwood | 81/52.4 R |
| 2,923,191 | 2/1960 | Fulop . | |
| 3,398,611 | 8/1968 | Hahner . | |
| 3,442,360 | 5/1969 | Fulop | 81/52.4 R |
| 3,651,718 | 3/1972 | Thomsian | 81/52.4 R |
| 3,727,432 | 4/1973 | Eaves et al. | 81/52.4 R |

*Primary Examiner*—James L. Jones, Jr.

*Attorney, Agent, or Firm*—Norman S. Blodgett; Gerry A. Blodgett

[57] ABSTRACT

Torque wrench having an output shaft driven through a torque-limiting clutch including a clutch cam and a clutch ball held in driving relationship by a spring.

7 Claims, 7 Drawing Figures

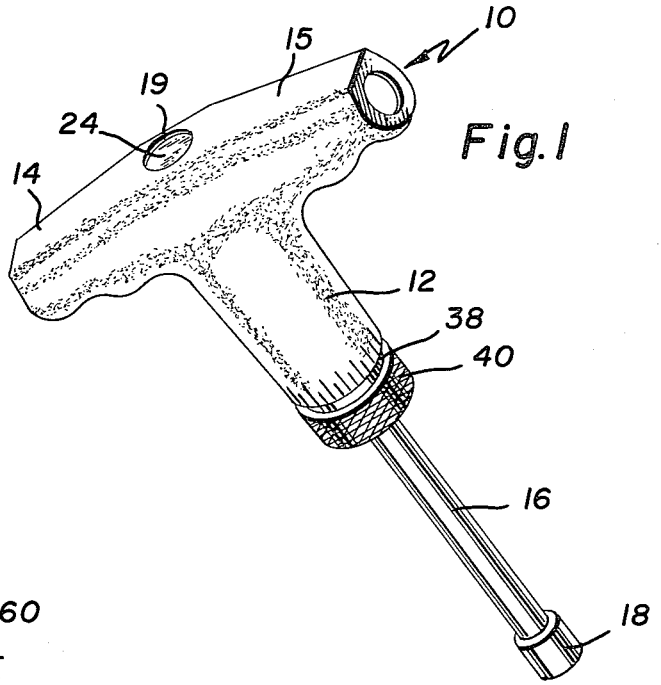
Fig. 1
Fig. 2
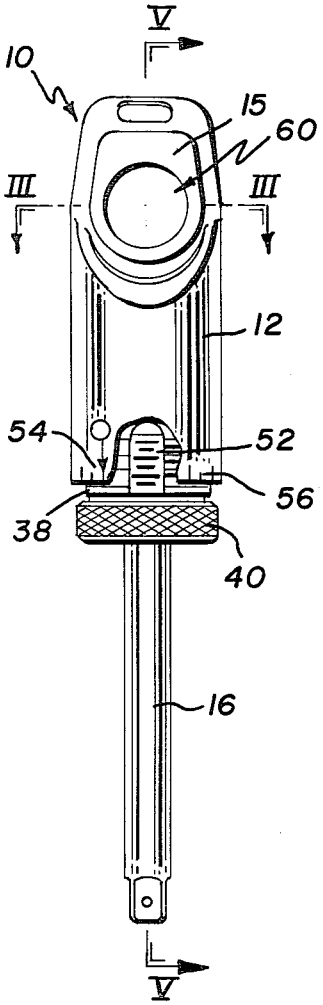
Fig. 3
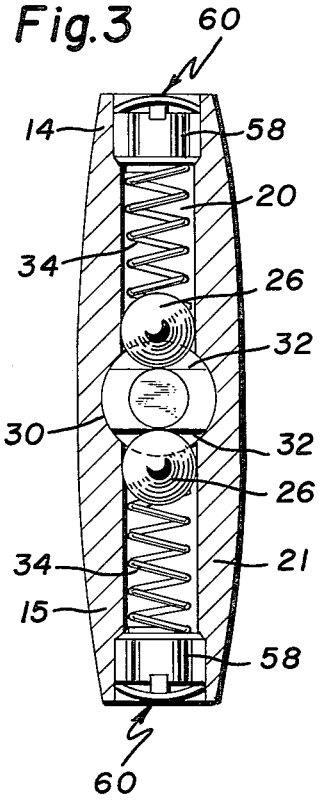
Fig. 4
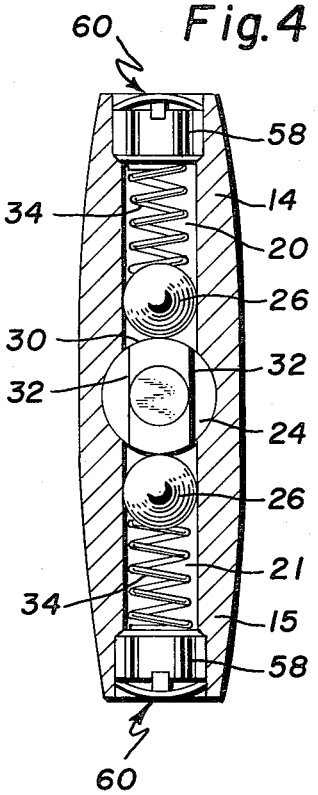

TORQUE WRENCH

BACKGROUND OF THE INVENTION

This invention relates generally to wrenches having a torque-limited drive and, more particularly, to a hand tool with an internal torque-overload coupling or clutch. It is well known to provide power tools with a torque-overload coupling which is disengaged when a selected maximum load torque is exceeded. The torque transmitting coupling or clutch usually comprises a driving element which transmits driving torque to a driven element through the use of balls or roller with seating grooves. The balls are either carried by or engaged by a spring-biased conical element into driving position with respect to the grooves. Excess torque urges the balls against the conical element. This condition produces high frictional forces between the balls and conical element. Continued re-engagement and disengagement of the coupling element against the spring loading, results in rapid wear of the engaging surfaces and in a change in the amount of the torque required for disengagement. Most of the prior art torque overload wrenches have no provision for adjusting the coupling to disengage under different driving torques and those that are so provided are either complex or have limited adjustability. These and other difficulties experienced with the prior art devices have been obviated in a novel manner by the present invention.

It is, therefore, an outstanding object of the invention to provide a torque-limited wrench which avoids all of the problems of the prior art wrenches by providing a torque-limiting clutch in which there is no axial displacement of the cone element during de-clutching.

Another object of this invention is the provision of a torque wrench in which displacement forces for de-clutching are applied directly against the clutch spring.

A further object of the present invention is the provision of a torque wrench in which displacement of the clutch element biased by the clutch spring is along a line extending transversely of the torque axis.

It is another object of the instant invention to provide a torque wrench having means for adjusting the clutch for changing the selected maximum torque value for de-clutching.

A still further object of the invention is the provision of a torque wrench in which the means for selecting the maximum torque value for de-clutching is simple and precise.

It is a further object of the invention to provide a torque wrench in which the means for adjusting the clutch is provided with a torque scale caliberated to measure the amount of maximum torque required to disengage the clutch.

It is a further object of the invention to provide a torque wrench which is particularly adapted for hand-operation.

It is a further object of the invention to provide a torque wrench which is sturdy, reliable, simple in construction, and easy to manufacture.

With these and other objects in view, as will be apparent to those skilled in the art, the invention resides in the combination of parts set forth in the specification and covered by the claims appended hereto.

SUMMARY OF THE INVENTION

In general, the invention consists of a housing having an output shaft mounted for rotation about a central longitudinal axis. A torque-limiting clutch is also located within the housing and comprises a clutch cam operatively connected to the output shaft for rotation therewith. A clutch ball is mounted for movement toward and away from the cam on a line which is substantially transverse to the longitudinal axis of the output shaft and a spring is provided for resiliently biasing the clutch ball into driving engagement with the clutch cam. The clutch cam is generally conical and is formed with a recess area. The clutch is effective to provide a driving connection between the housing and the output shaft when the ball is in contact with the recess portion of the clutch cam. When the selected maximum torque is applied to the output shaft, the cam is effective to push the ball toward the biasing spring away from the recess and out of driving position with respect to the clutch cam.

More specifically, the clutch cam is cone shaped and its central longitudinal axis is coaxial with the central longitudinal axis of the output shaft. The recess extends in a direction which is generally parallel to a longitudinal axis of the clutch cam; it is, therefore, closer to the outer surface of the clutch cam at its narrow end than at its wide end, thereby requiring less force to move the clutch ball out of driving engagement with the recess at the narrow end of the clutch cam and a relatively greater force at the wider end. Adjustment is made by an adjusting screw having a threaded shank portion attached to the clutch cam and a head portion extending below the housing. The shank of the adjusting screw is provided with a scale caliberated to indicate the maximum torque value for each setting of the adjusting screw. The torque wrench is also provided with gripping handles which extend laterally of the housing and which also contain the clutch ball and biasing spring.

BRIEF DESCRIPTION OF THE DRAWINGS

The character of the invention, however, may be best understood by reference to one of its structural forms, as illustrated by the accompanying drawings, in which:

FIG. 1 shows a perspective view of the invention,

FIG. 2 is a side elevational view of the invention,

FIG. 3 is a horizontal sectional view of the invention taken on the line III—III of FIG. 2 showing the torque wrench clutch elements in engaging position, FIG. 4 is a view similar to FIG. 2 showing the clutch elements in the non-driving or dis-engaged position.

DESCRIPTION OF THE PREFERRED EMBODIMENT

Figure 5:
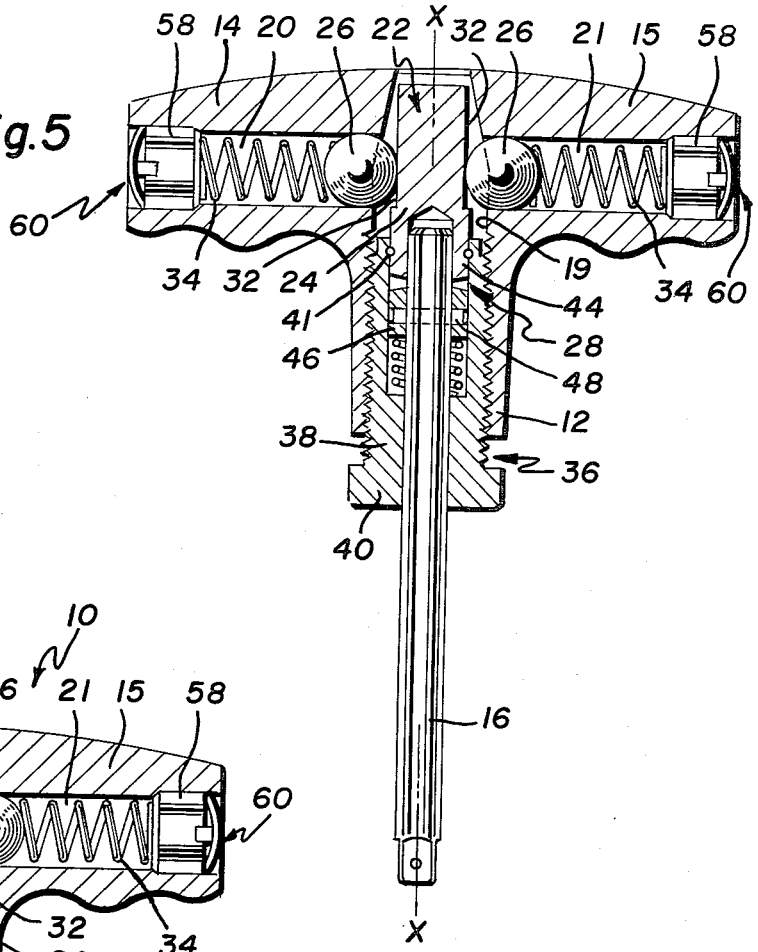
FIG. 5 is a vertical sectional view of the invention taken on the line V—V of FIG. 2 showing the clutch elements in engaged position and adjusted for the greatest maximum torque-limiting condition.

Referring first to FIGS. 1 and 2, the torque wrench of the present invention, indicated generally by the reference numeral 10, comprises a T-shaped housing having a main body portion 12 and a pair of handles 14 and 15 extending laterally from the main body 12. An output shaft 16 extends from the lower end of the main body and has an end adapted to receive a socket tool 18 shown in FIG. 1.

Figure 6:
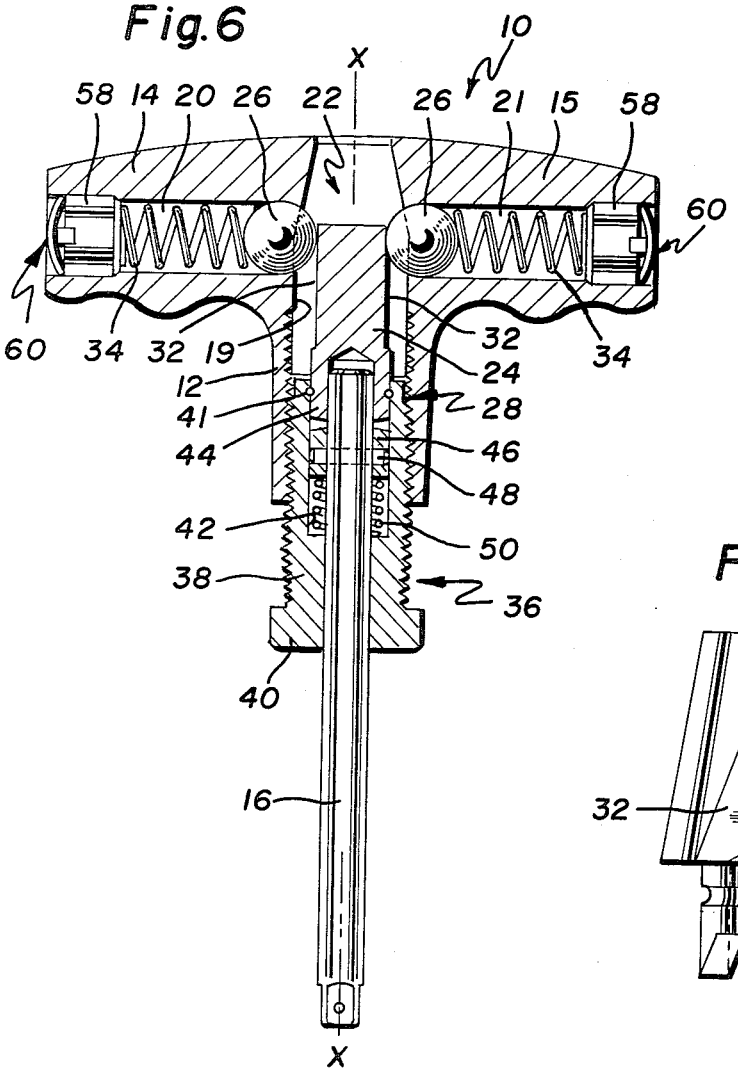
FIG. 6 is similar to FIG. 5 showing the clutch elements adjusted for the smallest maximum torque-limiting condition.
Figure 7:
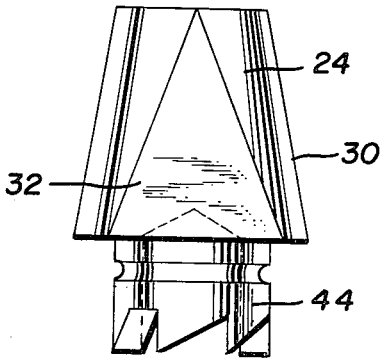
FIG. 7 is an elevational view showing the clutch cam in detail.

Referring to FIG. 5, the main body of the housing 12 is provided with a bore 19. Handles 14 and 15 are provided with bores 20 and 21, respectively, which extend laterally of the bore 19. A torque limiting clutch generally indicated at 22 is located within the housing and comprises a clutch cam 24 located in the bore 19 and a pair of clutch balls 26 located in bores 20 and 21. Clutch cam 24 is operatively connected to the upper end of output shaft 16 by means of a ratchet drive generally indicated by the reference numeral 28. Clutch cam 24 has an outer frusto-conical surface 30, see FIG. 7, which is interrupted by a pair of diametrically opposed recesses 32. The central longitudinal axis of the frusto-conical surface 30 is coaxial with the central longitudinal axis of the output shaft 16, said axis being indicated at X—X in FIGS. 5 and 6. Recesses 32 are flat surfaces which extend parallel to the axis X—X. When torque limiting clutch 22 is in the driving position, as shown in FIGS. 3, 5, and 6, balls 26 are urged against recess 32 by compression springs 34 located in bores 20 and 21. When the clutch is in the driving position, the housing is drivingly connected to the output shaft 16 through the clutch. Driving is accomplished by rotating the handles 14 and 15 about the axis X—X which produces a torque on the output shaft 16 through the torque limiting clutch 22. If the object to which the tool is applied, such as a nut, offers excess resistance to turning to the extent of producing a torque in the output shaft 16 which exceeds a predetermined maximum torque value, torque cam 24 will overcome the bias of springs 34. This allows the housing to rotate relative to the clutch cam as the balls 26 are moved outwardly away from recess surfaces 32 and into conical surface 30, as shown in FIG. 4. The outer position of the balls 26 is also shown in dotted lines in FIGS. 5 and 6. Additional rotation of the housing relative to output shaft 16 returns the clutch cam 24 to the position shown in FIGS. 3 and 5, whereby balls 26 will again be urged against recesses 32 in driving engagement therewith.

Wrench 10 is provided with a tubular adjusting screw generally indicated by the reference numeral 36 comprising a threaded shank portion 38 which is threaded into the lower end of bore 19 and a head portion 40 which extends below the housing. The upper end of shank portion 38 is connected to the lower portion of clutch cam 24 by means of balls 41. These are a series of 1/16" dia. Balls loaded thru an access hole in part 38 which is then plugged. These balls provide a thrust bearing which allows the cam 22 to freely rotate in the adjusting screw body 38. Head 40 is provided with an outer narrow gripping surface, as shown in FIGS. 1 and 2 to enable the user to adjust the position of the screw relative to the housing. Since screw 38 is connected to cam 24, moving of the screw relative to the housing also moves cam 24 relative to balls 26 along the X—X axis. FIG. 5 shows the innermost position of the adjusting screws, wherein the balls 26 are in engagement with the bottom portion of recess 32. In FIG. 6, screw 36 is shown in its furthermost retracted position, wherein balls 26 are in engagement with the upper portion of recess 32. Since the diameter of frusto-conical surface 30 is much greater at the bottom of cam 20 than at the top thereof, a much greater torsional force is required to move balls 26 from recess 32 to surface 30 at the lower wide end of cam 24 than at the upper narrow end. In the greater torque limiting position in FIG. 5, balls 26 must move laterally a greater amount as they move from recess 32 to surface 30, than the lesser torque limiting position shown in FIG. 6. This difference in lateral movement can be clearly seen by the difference between the dotted line and full line positions of the balls between FIGS. 5 and 6.

Adjusting screw 36 is provided with a bore 42 which contains the ratchet drive 28. Ratchet drive 28 comprises an upper toothed element 44 attached to the lower end of clutch cam 24 and a lower toothed element 46 slidably mounted within the bore 42. Lower tooth element 46 is drivingly connected to the output shaft 16 by means of a connecting pin 48. A compression spring 50 located in bore 42 urges the lower toothed element 46 into driving engagement with the upper toothed element 44.

As shown in FIG. 2, the shank portion 38 of the adjusting screw is provided with a scale 52 calibrated in major increments of torque and inch pounds. The calibration is such that as the screw 40 is moved relative to the housing, the bottom edge 54 of the housing will be aligned with a measurement on the scale 52 which is equal to the maximum torque limiting value of the clutch for each setting. The bottom edge of the housing is also provided with a scale 56 which is calibrated in fractions of the increments of scale 52. This enables precise adjustments to be made. For example, scale 56 may have a zero arrow and nine other increment marks cast into it. If one revolution of the adjusting screw is equivalent to ten inch pounds, then the calibration of scale 52 is such that the screw 40 will be displaced relative to the bottom edge 54 by an amount equal to the distance between each mark on the scale 52 and each mark therefore is equivalent to 10 inch pounds. Proper calibration is achieved during manufacture of the wrench by calibration screws 58 threaded into the outer end of bores 20 and 21. Screws 58 are utilized to increase or decrease the tension of springs 34, so that the readings on scales 56 and 52 correlate with the torque limiting values of the various positions of clutch cam 24. Once proper calibration is achieved, the calibration screws 58 are locked and sealed by appropriate locking and sealing means generally indicated by the reference numeral 60.

The wrench is, therefore, capable of being used for a wide range of work applications having different torque limiting requirements. The wrench provides for easy and accurate adjustment for different torque-limiting values.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A torque wrench comprising;

(a) a housing, (b) an output shaft within the housing mounted for rotation about its central longitudinal axis, (c) a clutch cam located within the housing and operatively connected to the output shaft for rotation therewith, said clutch cam having a frusto-conical outer surface, the central longitudinal axis of the output shaft, said clutch cam also having a recessed flat surface that is parallel to said axis, (d) a clutch ball mounted within the housing for movement toward and away from said flat surface along a line which is substantially transverse to said longitudinal axis, (e) a spring for resiliently biasing the clutch ball into said recess for driving engagment with the clutch cam, whereby rotation of the housing about said longitudinal axis will cause rotation of the output shaft, said clutch ball being movable out of said recess onto said outer surface against the biasing means for disengagement of the clutch ball cam for a predetermined maximum torque of the output shaft, and (f) adjusting means for adjustably positioning the clutch cam along its central longitudinal axis and thereby varying the position of the clutch ball along the length of the recess for selectively varying the amount of torque required to move the ball from the recess to said conical surface.

2. A torque wrench as recited in claim 1, wherein said adjusting means comprises a tubular adjusting screw which fits freely over the output shaft, said adjusting screw comprising:

(a) a gripping head located outside of the housing, and (b) a shank which is threaded into the housing and connected to the clutch cam.

3. A torque wrench as recited in claim 2, wherein the housing has a bottom edge and wherein a portion of the shank adjacent the gripping head is provided with a torque scale calibrated so that the maximum torque value for any adjusted position of the clutch cam is aligned with said bottom edge.

4. A torque wrench as recited in claim 3, wherein said bottom edge is also provided with a torque scale calibrated in fractional increments of the scale on said shank for fine adjustment.

5. A torque wrench as recited in claim 1, wherein the clutch cam is provided with a pair of diametrically opposed flat surfaces and there is provided a clutch ball and associated spring for each flat surface.

6. A torque wrench as recited in claim 5, wherein each clutch ball and its associated spring is located in a bore within a portion of the housing which extends laterally from said longitudinal axis, said laterally extending portion serving as a handle for the wrench.

7. Torque wrench as recited in claim 1, wherein the clutch cam is operatively connected to the output shaft through a ratchet drive.

* * * * *